US010190202B2

(12) United States Patent
Fontaine

(10) Patent No.: US 10,190,202 B2
(45) Date of Patent: Jan. 29, 2019

(54) METHOD AND DEVICE FOR COATING A METAL STRIP

(71) Applicant: FONTAINE ENGINEERING UND MASCHINEN GMBH, Langenfeld (DE)

(72) Inventor: Dominique Fontaine, Langenfeld (DE)

(73) Assignee: FONTAINE ENGINEERING UND MASCHINEN GMBH, Langenfeld (DE)

( * ) Notice: Subject to any disclaimer, the term of this patent is extended or adjusted under 35 U.S.C. 154(b) by 0 days.

(21) Appl. No.: 15/528,567

(22) PCT Filed: Sep. 24, 2015

(86) PCT No.: PCT/EP2015/071963
§ 371 (c)(1),
(2) Date: May 22, 2017

(87) PCT Pub. No.: WO2016/078805
PCT Pub. Date: May 26, 2016

(65) Prior Publication Data

US 2017/0268092 A1 Sep. 21, 2017

(30) Foreign Application Priority Data

Nov. 21, 2014 (DE) ..... 10 2014 223 819
Dec. 11, 2014 (DE) ..... 10 2014 225 516

(51) Int. Cl.
*B05C 3/02* (2006.01)
*B05C 3/12* (2006.01)
(Continued)

(52) U.S. Cl.
CPC ..... *C23C 2/20* (2013.01); *B05C 3/02* (2013.01); *B05C 3/125* (2013.01); *B05C 11/06* (2013.01);
(Continued)

(58) Field of Classification Search
CPC .. C23C 2/003; C23C 2/06; C23C 2/14; C23C 2/16; C23C 2/18; C23C 2/20; C23C 2/40;
(Continued)

(56) References Cited

U.S. PATENT DOCUMENTS

2009/0031950 A1* 2/2009 Deka ..... C21D 1/767
118/429

FOREIGN PATENT DOCUMENTS

DE 4300868 C1 3/1994
DE 102007042897 A1 * 3/2009 ..... B21C 47/34
(Continued)

OTHER PUBLICATIONS

International Search Report and Written Opinion dated Dec. 17, 2015 in corresponding Application No. PCT/EP2015/071963; 14 pgs.
(Continued)

*Primary Examiner* — William P Fletcher, III
(74) *Attorney, Agent, or Firm* — Maier & Maier, PLLC

(57) ABSTRACT

A method and a device for coating a metal strip with a coating material that is still liquid at first. During the coating, the coated metal strip runs through a roller pair. One of the rollers of the roller pair can be adjusted toward the other as a correction roller in order to eliminate a possible curvature of the metal strip. Then the metal strip runs through a blow-off apparatus for blowing off surplus coating. In order to prevent an uneven thickness distribution of the coating on the metal strip even when the correction roller of the roller pair has been adjusted, the actual position of the metal strip is controlled to a specified setpoint center position in the slot of the blow-off apparatus by an appropriate movement of the blow-off apparatus.

6 Claims, 1 Drawing Sheet

(51) Int. Cl.

| | |
|---|---|
| ***B05D 1/18*** | (2006.01) |
| ***B05D 3/00*** | (2006.01) |
| ***B05D 3/04*** | (2006.01) |
| ***B05D 7/14*** | (2006.01) |
| ***C23C 2/00*** | (2006.01) |
| ***C23C 2/06*** | (2006.01) |
| ***C23C 2/14*** | (2006.01) |
| ***C23C 2/16*** | (2006.01) |
| ***C23C 2/18*** | (2006.01) |
| ***C23C 2/20*** | (2006.01) |
| ***C23C 2/40*** | (2006.01) |
| ***B05C 11/06*** | (2006.01) |

(52) U.S. Cl.

CPC ..... *B05D 1/18* (2013.01); *B05D 3/007* (2013.01); *B05D 3/0466* (2013.01); *B05D 7/14* (2013.01); *C23C 2/003* (2013.01); *C23C 2/06* (2013.01); *C23C 2/14* (2013.01); *C23C 2/16* (2013.01); *C23C 2/18* (2013.01); *C23C 2/40* (2013.01); *B05D 2202/00* (2013.01); *B05D 2252/00* (2013.01); *B05D 2252/02* (2013.01); *B05D 2252/04* (2013.01); *B05D 2252/10* (2013.01)

(58) Field of Classification Search

CPC ..... B05D 1/18; B05D 3/007; B05D 3/0466; B05D 7/14; B05D 2202/00; B05D 2252/00; B05D 2252/02; B05D 2252/04; B05D 2252/10; B05C 3/00; B05C 3/02; B05C 3/125

USPC ..... 427/434.4, 126.1, 321, 433, 434.2, 99.2, 427/209, 348, 349; 118/62, 63, 56, 405, 118/419, 600, 429, 26, 400, 122, 117, 118/118, 119

See application file for complete search history.

(56) References Cited

FOREIGN PATENT DOCUMENTS

| | | | | | |
|---|---|---|---|---|---|
| DE | 102007042897 | A1 | | 3/2009 | |
| DE | 102009051932 | A1 | | 5/2011 | |
| DE | 102016222224 | A1 | * | 8/2017 | |
| JP | H10-298727 | A | | 11/1998 | |
| JP | 2003113460 | A | * | 4/2003 | |
| JP | 2003113460 | A | | 4/2003 | |
| JP | 2010-156023 | A | | 7/2010 | |
| RU | 2 463 643 | C1 | | 12/2011 | |
| WO | 94/02658 | A1 | | 2/1994 | |
| WO | WO-9402658 | A1 | * | 2/1994 | ..... C23C 2/20 |
| WO | WO-2013144194 | A1 | * | 10/2013 | ..... B23K 35/365 |
| WO | 2013/168668 | A1 | | 11/2013 | |

OTHER PUBLICATIONS

Translation of the International Preliminary Report on Patentability dated May 26, 2017, in connection with corresponding international Application No. PCT/EP2015/071963 (12 pgs.).

Russian Decision to Grant a Patent dated Jun. 15, 2018, in connection with corresponding RU Application No. 2017121559/02(037311) (8 pgs.).

Russian Search Report dated Jun. 7, 2018, in connection with corresponding RU Application No. 2017121559/02(037311) (2 pgs.).

Korean Office Action dated May 11, 2018, in connection with corresponding KR Application No. 10-2017-7013145 (11 pgs., including English translation).

Office Action dated Aug. 23, 2018 in corresponding Korean Patent Application No. 10-2017-7013145; 6 pages including English-language translation.

Japanese Office Action dated Aug. 27, 2018, in connection with corresponding JP Application No. 2017-546012 (8 pgs., including machine-generated English translation).

* cited by examiner

METHOD AND DEVICE FOR COATING A METAL STRIP

FIELD

The invention relates to a method and a device for coating a metal strip with an initially still liquid coating material, for example zinc. The method and device serve for, in particular, hot-dip galvanising of the metal strip.

BACKGROUND

Devices of that kind for coating a metal strip are basically known in the prior art thus, for example, from DE 10 2009 051 932 A1. In concrete terms, this specification discloses a coating container filled with a liquid coating material. For coating, the metal strip is conducted through the container with the coating material. After leaving the coating container the metal strip runs through a blowing device, which is arranged above the coating container, for blowing excess parts of the still liquid coating material off the surface of the metal strip. An electromagnetic stabilising device for stabilising the metal strip after leaving the coating container and the blowing device is arranged above the blowing device and is supported by the blowing device. The electromagnetic stabilising device has the effect, in particular, that the strip is held centrally in a centre plane of the overall device and that oscillations of the metal strip during transit through the coating container and the blowing device are prevented or at least reduced.

Each of the blowing device and the electromagnetic stabilising device has a respective slot through which the metal strip is guided. In order to achieve a uniform thickness or thickness distribution of the coating material on the upper side and lower side of the metal strip it is essential for the metal strip to run in a predetermined target centre position through the slot of the blowing device. Only then is it guaranteed that the action of the blowing nozzles of the blowing device on the upper side and lower side of the metal strip is the same and a desired uniform thickness distribution of the coating material on the metal strip results.

The target centre position is defined by, in particular, a preferably uniform spacing of the wide sides and the narrow sides of the metal strip from the oppositely disposed nozzles of the blowing device and, in particular, by the fact that the metal strip is not inclined, twisted or too-strongly curved relative to the longitudinal orientation of the slot or the nozzles.

However, in practice it can happen that the metal strip after leaving the coating container is strongly curved. Such a curvature is, as stated, undesirable particularly for passage through the blowing device. Traditionally, the curvature is therefore counteracted by a correction roller being adjusted against the metal strip before the metal strip enters the blowing device. However, this has the disadvantage that as a consequence the actual position by which the metal strip runs through the slot of the blowing device can depart from the target centre position, which can lead to the above-described problem of a non-uniform thickness distribution of the coating.

German published specification DE 10 2007 042 897 A1 discloses a method with a device for coating a metal strip with a coating material, for example zinc. For this purpose, the metal strip is conducted through a coating container filled with the liquid coating material, in which case the coating material adheres to the surface of the metal strip. After leaving the coating container the metal strip runs through a slot of a blowing device which serves the purpose of blowing excess parts of the still liquid coating material off the surface of the metal strip. In addition, a curvature sensor is provided for detecting the actual curvature of the metal strip after leaving the coating container. Insofar as the detected actual curvature exceeds a predetermined permissible curvature threshold value, a correction roller is adjusted against the metal strip in order to smooth this. Control of the blowing device is also disclosed.

Specification DE 43 00 868 C1 teaches positioning of the blowing device with the help of adjusting drives so that the spacing between nozzle gap and strip surface remains constant. The corresponding control or regulation of the position of the blowing device is carried out in dependence on the actual position of the metal strip, which is continuously detected by a separate measuring device.

WO 94/02658 A1 teaches provision at least implicitly of a curvature sensor for detecting the curvature of the metal strip above the blowing device. If excessive curvature is ascertained so that there is a possible risk of contact between strip and blowing device the blowing device is moved transversely to the plane of the metal strip until a minimum spacing between metal strip and blowing device is reinstated over the entire width of the metal strip.

JP 2003 113460 A provides a so-called displacement sensor (numerical value), which is arranged in the electromagnetic stabilising device and which is formed to detect the state of curvature or the amount of eccentricity of the metal strip in the slot of the electromagnetic stabilising device. Depending on the amount of eccentricity of the metal strip current is supplied to the electromagnets of the electromagnetic stabilising device so as to generate magnetic forces on the metal strip of such a kind that the curvature and the path position of the metal strip are corrected. A stabilising roller and the correction roller are controlled or positioned in the metal bath with the help of a process control device in dependence on the output values. In addition, stripper nozzles are controlled and positioned in correspondence with a mathematically determined eccentricity index and, in particular, so that the index or eccentricity of the metal strip lies within or below a predetermined threshold value. The stripper nozzles and the electromagnetic units or the electromagnetic stabilising device are respectively moved in parallel by the same amount.

The invention has the object of developing a known method and a known device, of the kind stated in the introduction, for coating a metal strip in such a way that non-uniform thickness distribution of the coating on the metal strip is prevented by way of adjustment of the correction roller.

SUMMARY

Through the claimed displacement of the blowing device in such a way that the metal strip again lies in the predetermined target centre position in the slot of the blowing device it is advantageously achieved that a non-uniform thickness distribution of the coating on the metal strip is prevented by way of the adjustment of the correction roller or by way of a change in the adjustment of the correction roller.

According to a first embodiment, the previously detected deviation of the actual position of the metal strip from its target centre position can also serve as a criterion or as a measure for the displacement of the blowing device additionally to the adjustment of the correction roller. This criterion offers the advantage that it provides a quite precise pointer to the necessary displacement of the blowing device.

According to a further embodiment provision is made to stabilise the metal strip, particularly against undesired oscillations, after the departure from the coating container and the blowing device with the help of an electromagnetic stabilising device arranged above the blowing device. Typically, the stabilising device is mechanically supported on the upstream blowing device. The electromagnetic stabilising device is also termed Dynamic Electro Magnetic Coating Optimizer DEMCO by the Applicant.

The advantages of this solution correspond with the advantages stated above with respect to the claimed method. Advantageous embodiments of the device are the subject of the dependent claims.

DETAILED DESCRIPTION

Figure 1:
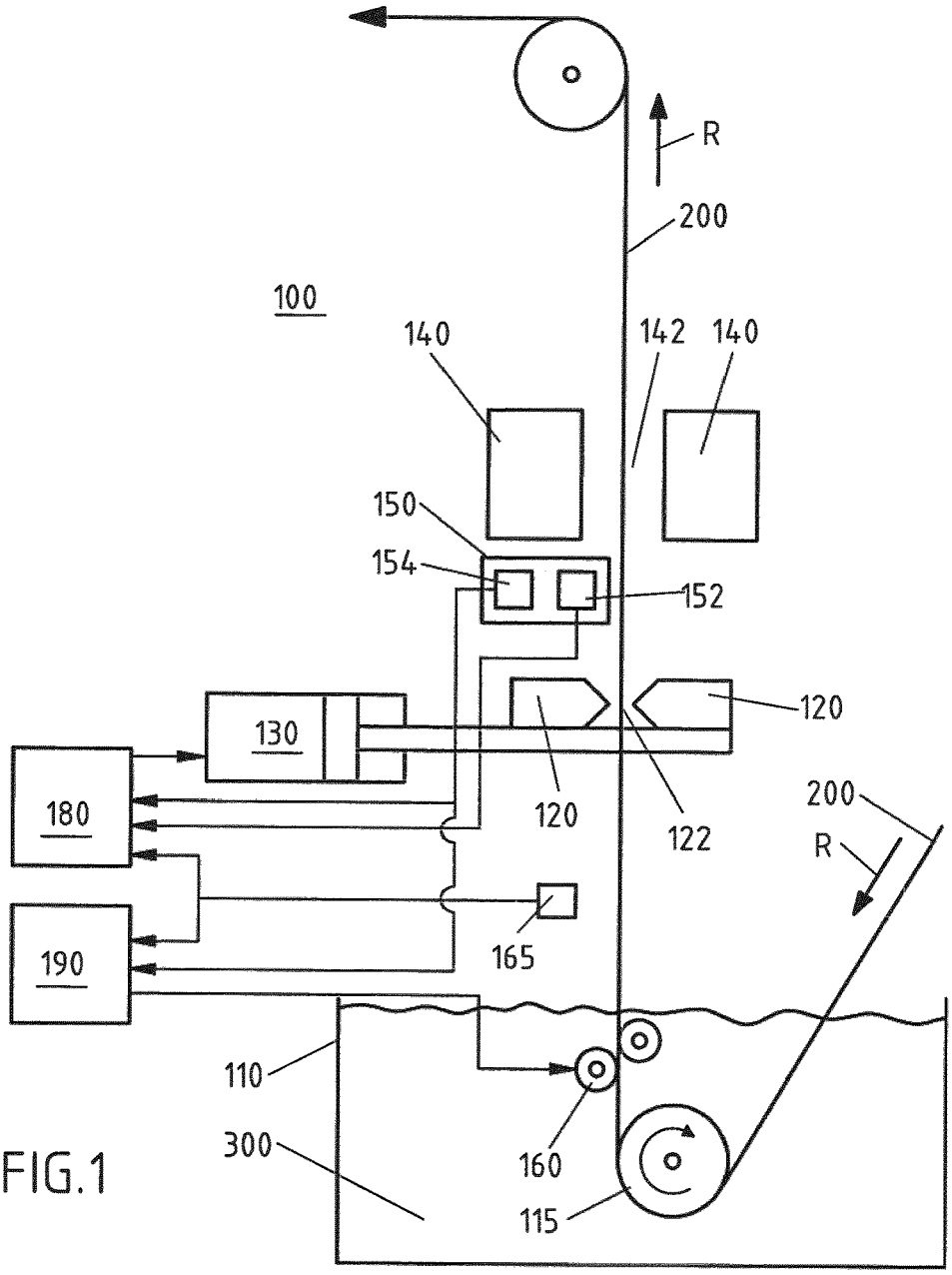
FIG. 1 shows the device according to the invention in an overall view.

The invention is described in detail in the following in the form of embodiments with reference to the mentioned figures. The same technical elements are denoted by the same reference numerals in both figures.

FIG. 1 shows the device 100 according to the invention for coating a metal strip 200 with a liquid coating material 300, for example zinc. For this purpose, the initially still uncoated metal strip 200 is conducted in transport direction R in a coating container 110 filled with the liquid coating material. Within the coating container 110 the metal strip 200 is deflected with the help of a deflecting roller so that it leaves the coating container upwardly. After the transit through the coating container, the still liquid coating material adheres to the metal strip 200.

A roller pair between which the coated metal strip is guided through is arranged downstream of the deflecting roller 115 in the transport direction R of the metal strip 200. The roller pair is typically arranged within the coating container 110 so that it is surrounded by the coating material 300 during performance of the coating process. One of the rollers is adjustable as a correction roller 160 towards the other roller of the roller pair so as to smooth the metal strip if an undesired curvature is present. For this purpose, the amount of curvature of the metal strip 200 is detected with the help of a curvature sensor 154 and compared with a predetermined curvature threshold value. The comparison can be carried out in a control device 190. If the amount of curvature of greater than the curvature threshold value then the correction roller is adjusted, under the control of the control device 190, relative to the metal strip.

Arranged downstream of the roller pair in transport direction R of the metal strip is a blowing device 120 which spans a slot 122 through which the metal strip 200 is guided. Excess coating material is blown off the surface of the metal strip 200 with the help of the blowing device.

Figure 2:
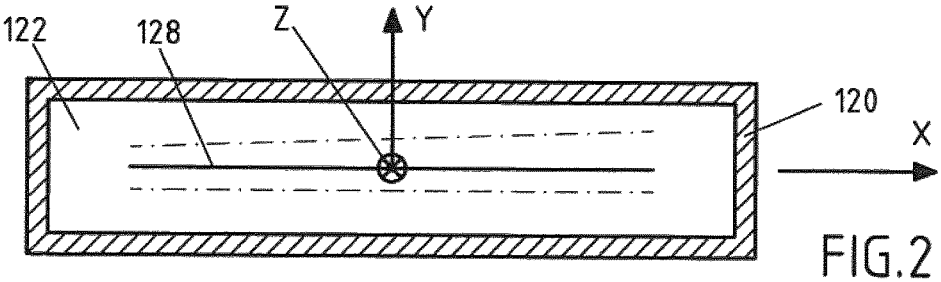
FIG. 2 shows a plan view of the slot of the blowing device.

In order that blowing onto the upper side and lower side of the metal strip 200 takes place uniformly it is important that the metal strip 200 runs through the slot 122 of the blowing device 120 in a predetermined target centre position 128, as symbolised in FIG. 2 in the form of the solid line in X direction. This target centre position is distinguished by, in particular, uniform spacings or spacing distributions from the inner edges of the slot 122 of the blowing device 120. Apart from the desired predetermined target centre position, possible undesired actual positions of the metal strip are also depicted, as dashed lines, in FIG. 2. Undesired actual positions for the metal strip are thus present, for example, if it is twisted relative to the target centre position or shifted parallelly in Y direction.

With further reference to FIG. 1 there can be seen above the blowing device 120 an electromagnetic stabilising device 140 which in turn has a slot 142 through which the metal strip 200 is similarly guided. It is also the case here that the metal strip 200 preferably runs through the slot 142 in a predetermined target centre position 128, as shown in FIG. 2, so that in desired manner the forces provided by the electromagnetic stabilising device 140 can have a uniform stabilising action on the metal strip 200.

A position sensor is provided for detecting a deviation of the actual position of the metal strip 200 from a predetermined target centre position in the slot 122 of the blowing device 120. In addition, a regulating device 180 is provided for regulating the actual position of the metal strip 200 to the predetermined target centre position in the slot 122 of the blowing device, as explained above with reference to FIG. 2, by displacing the blowing device 120 with the help of a displacing device 130. The displacement is carried out in a plane transverse to the transport direction R of the metal strip. The regulation is carried out in response to the deviation, which is detected by the position sensor 152, of the actual position from the target centre position of the metal strip 200. The regulation can optionally also be carried out with additional consideration of the amount of curvature of the metal strip detected by the curvature sensor 154.

The position sensor 152 and the curvature sensor 154 are both part of a metal strip detecting device 150. According to one embodiment, the function of the position sensor 152 and the curvature sensor 154 can be realised by a single, typically laser-supported, sensor device, also termed "laser" for short; the position sensor 152 and the curvature sensor 154 then form one constructional unit in the form of the sensor device or the metal strip detecting device.

According to a first alternative the displacement of the blowing device 120 can be carried out as a function of the detected deviation of the actual position of the metal strip from the predetermined target centre position in the slot 122 of the blowing device. In other words: if it is ascertained that the metal strip 200 does not run through the slot 122 in the target centre position 128 then the blowing device 120 is displaced with the help of the displacing device 130 in such a way that the metal strip again runs through the slot 122 of the blowing device in the predetermined target centre position 128 so as to ensure the desired uniform coating.

According to a second alternative or additionally the displacement of the blowing device 120 can also be carried out with consideration of the adjusted position, which is detected by a correction roller detecting device 165, of the correction roller 160 or the change thereof. For this purpose, the output of the correction roller detecting device 165 is also coupled to the input of the regulating device 180. In this way the displacement of the blowing device was improved with respect to a desired maximisation of uniformity during the coating. The correction roller detection device 165 can be constructed in the form of two encoders, each of which is seated on a respective drive of the correction roller 160.

The metal strip and correction roller detection devices 150, 165 are constructed to preferably recognise all conceivable deviations of an actual position of the metal strip from the desired target centre position. Amongst those is, in particular, a (parallel) shifting of the metal strip in X or Y direction or a rotation such as explained above with reference to FIG. 2. Accordingly, the displacing device 130—in the case of suitable control by the regulating device 180—is constructed to move the blowing device 120 in a desired manner in a plane transverse to the transport direction R of the metal strip, particularly to shift (parallelly) or to rotate, so as to realise transit of the metal strip in the target centre position. To that extent, the illustration of the displacing device 130 as a piston-cylinder unit is merely exemplifying, but not limiting.

REFERENCE NUMERAL LIST

100 device
110 coating container
115 deflecting roller
120 blowing device
122 slot of the blowing device
128 target centre position of the metal strip in the blowing device or the electromagnetic stabilising device
130 displacing device
140 electromagnetic stabilising device
142 slot of the electromagnetic stabilising device
150 metal strip detecting device
152 position sensor
154 curvature sensor
160 correction roller
165 correction roller detecting device
180 regulating device
190 control device
200 metal strip
300 coating material
R transport direction of the metal strip
X width direction of the metal strip in target centre position
Y direction transverse to the plane spanned by the metal strip
Z direction perpendicular to the X-Y plane

The invention claimed is:

1. A device for coating a metal strip with a coating material, comprising:

a coating container with a correction roller, wherein the coating container is fillable with a liquid coating material, for conducting through the metal strip, and wherein the coating material adheres to the surface of the metal strip to be coated;

a blowing device, which is arranged downstream of the coating container in the transport direction of the metal strip, with a slot for conducting through the metal strip and for blowing excess parts of the still liquid coating material off the surface of the metal strip;

a curvature sensor for detecting the actual curvature of the metal strip after leaving the coating container;

a control device for adjusting the correction roller against the metal strip if the amount of the actual curvature exceeds a predetermined permissible curvature threshold value;

a regulating device for regulating the actual position of the metal strip to the predetermined target centre position in the slot of the blowing device by displacing the blowing device in a plane transverse to the transport direction of the metal strip with the help of a displacing device; and a correction roller detection device for detecting the adjusted position of the correction roller or the change thereof;

wherein the displacement of the blowing device is carried out with consideration of the adjusted position of the correction roller.

2. The device according to claim 1, further comprising:

a position sensor for detecting the deviation of the actual position of the metal strip relative to the target centre position during passage through the slot of the blowing device due to the adjustment of the correction roller relative to the metal strip; and the displacement of the blowing device is carried out as a function of the detected deviation.

3. The device according to claim 1, further comprising:

an electromagnetic stabilising device, which is arranged above the blowing device, for stabilising the metal strip after leaving the coating container and the blowing device.

4. A method of coating a metal strip with a coating material, comprising:

conducting the metal strip to be coated through a coating container filled with a liquid coating material, wherein the coating material adheres to the surface of the metal strip to be coated;

conducting the coated metal strip through a slot of a blowing device, which is downstream of the coating container in the transport direction of the metal strip, for blowing excess parts of the still liquid coating material off the surface of the metal strip;

detecting the actual curvature of the metal strip after leaving the coating container;

adjusting a correction roller, which is arranged within the coating container, against the metal strip for smoothing the metal strip when the amount of the actual curvature exceeds a predetermined permissible curvature threshold value, wherein the actual position of the metal strip in the slot of the blowing device changes due to the adjustment of the correction roller;

regulating the actual position of the metal strip to a predetermined target centre position in the slot of the blowing device by displacing the blowing device in the plane transverse to the transport direction of the metal strip;

the adjusted position of the correction roller or the change thereof is detected; and the displacement of the blowing device is carried out with consideration of the adjusted position of the correction roller.

5. The method according to claim 4, wherein the deviation of the actual position of the metal strip from its target centre position in the slot of the blowing device is detected; and the displacement of the blowing device is carried out as a function of the detected deviation.

6. The method according to claim 4, further comprising:

stabilising the metal strip after leaving the coating container and the blowing device by an electromagnetic stabilising device arranged above the blowing device.

* * * * *